US008915750B2

(12) United States Patent
Phan et al.

(10) Patent No.: US 8,915,750 B2
(45) Date of Patent: Dec. 23, 2014

(54) PLUG CONNECTOR WITH MIS-INSERT FEATURES AND CORRESPONDING RECEPTACLE CONNECTOR THEREWITH

(71) Applicants: Duong Phan, Westminister, CA (US); Terrance F. Little, Fullerton, CA (US); Stephen Sedio, Valley Center, CA (US); An-Jen Yang, Irvine, CA (US); Yung-Jyh Ling, Portland, OR (US)

(72) Inventors: Duong Phan, Westminister, CA (US); Terrance F. Little, Fullerton, CA (US); Stephen Sedio, Valley Center, CA (US); An-Jen Yang, Irvine, CA (US); Yung-Jyh Ling, Portland, OR (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 138 days.

(21) Appl. No.: 13/738,946

(22) Filed: Jan. 10, 2013

(65) Prior Publication Data

US 2013/0273767 A1 Oct. 17, 2013

Related U.S. Application Data

(60) Provisional application No. 61/624,420, filed on Apr. 16, 2012.

(51) Int. Cl.

| | |
|---|---|
| ***H01R 13/627*** | (2006.01) |
| ***H01R 13/645*** | (2006.01) |
| ***H01R 13/64*** | (2006.01) |
| ***H01R 13/60*** | (2006.01) |

(52) U.S. Cl.

CPC ..... *H01R 13/6271* (2013.01); *H01R 13/645* (2013.01); *H01R 13/6275* (2013.01); *H01R 13/64* (2013.01); *H01R 13/60* (2013.01)

USPC ..... 439/358; 439/607.53; 439/692

(58) Field of Classification Search

CPC ..... H01R 13/645; H01R 13/64; H01R 13/642

USPC ..... 439/353, 358, 607.53, 692, 787

See application file for complete search history.

(56) References Cited

U.S. PATENT DOCUMENTS

| | | | | |
|---|---|---|---|---|
| 7,771,236 | B2 | 8/2010 | Koyama et al. | |
| 2005/0245132 | A1 * | 11/2005 | Huang et al. | 439/607 |
| 2009/0047821 | A1 * | 2/2009 | Chen et al. | 439/358 |
| 2011/0201224 | A1 * | 8/2011 | Hanson et al. | 439/353 |
| 2013/0273767 | A1 * | 10/2013 | Phan et al. | 439/358 |
| 2013/0273784 | A1 * | 10/2013 | Little et al. | 439/660 |

* cited by examiner

*Primary Examiner* — James Harvey

(74) *Attorney, Agent, or Firm* — Wei Te Chung; Ming Chieh Chang

(57) ABSTRACT

A plug connector (100) comprises an insulative housing (1), a plurality of terminals (2) retained to the insulative housing (1), a pair of latches (3) fit to the insulative housing (1) and a housing cover (4) attached to the insulative housing (1). The insulative housing (1) has a base portion (11) and a tongue portion (12) extending forwardly from a middle of the base portion (11). The terminals (2) are arranged on the tongue portion (12) in parallel. The housing cover (4) has a cylindrical portion (41) with a pair of slits (411) extending therethrough for the latch (3) partly extending through. Each latch (3) has a locking piece (31) provided with a front straight edge (311) to abut against with a front edge of a receptacle connector (900) when the plug connector (100) is inserted upside down to the receptacle (900).

16 Claims, 15 Drawing Sheets

PLUG CONNECTOR WITH MIS-INSERT FEATURES AND CORRESPONDING RECEPTACLE CONNECTOR THEREWITH

This application claims benefit of the provisional application 61/624,420 filed Apr. 16, 2012.

BACKGROUND OF THE INVENTION

1. Field of the Invention

The present invention generally relates to a plug connector, more particularly to a plug connector with anti-misinsertion features for preventing the plug connector from being inserted into a receptacle connector upside-down.

2. Description of Related Art

The USB connector as an interface, is popularly used in the industry. FIG. 1 shows the Micro B receptacle 10 defines chamfered structures 12 thereof to conform with the Micro B plug 20 which is also equipped with the chamfered structures 22 so as to prevent an upside down mis-mating as shown in FIG. 2. Anyhow, as shown in FIG. 3 the Micro AB receptacle 30 defines a rectangular interface without chamfered structure thereof for being matable with not only Micro B plug 20 but also Micro A plug (not shown) which defines a rectangular interface. Under such situation, the Micro B plug 20 may be mistakenly upside down inserted into the Micro AB receptacle 30 as shown in FIG. 4 wherein the inner mating tongue of the Micro AB receptacle may be damaged by the upside-down mis-mating Micro B plug 20.

U.S. patent issue No. US777,236 B2 issued on Aug. 10, 2010 discloses a plug connector including a housing with a tongue protruding forwardly, a plurality of contacts arranged in a row at a front side of the tongue, a hollow cover covering the housing. The cover has a top wall with a pair of slots extending therethrough and forms a mating port jointly with the tongue. A pair of latches mounted in the tongue have a pair of locking portions extending upwardly through the top wall of the cover to lock with a receptacle connector when the plug connector is inserted into the receptacle connector normally. The plug is a B-type Micro USB 2.0 plug connector. Each of the locking portion is arc-shaped and protrudes upwardly beyond the top wall, once the B-type Micro USB 2.0 plug connector is inserted upside down into an AB-type Micro USB 2.0 receptacle, which may cause damage of the plastic tongues of both the plug connector and the receptacle connector.

It is thus desired to provide an improved plug connector with improved latch features.

SUMMARY OF THE INVENTION

An objector of the invention is to provide a plug connector with an improved latch to prevent the plug connector from being inserted into a receptacle connector upside down.

According to one aspect of the present invention, it provides a plug connector comprising an insulative housing, a plurality of terminals retained to the insulative housing, a pair of latches fixed to the insulative housing and a housing cover partly covering the insulative housing. The insulative housing has a base portion and a tongue portion extending forwardly from a middle of the base portion. The tongue portion has a first surface and a second surface opposite to the first surface. The terminals are exposed toward the first surface of the tongue portion in parallel. The latches are fixed to the base portion and arranged in parallel for locking with a receptacle connector with a rectangular mating port. The latches are positioned at out sides of the terminals. The housing cover has a cylindrical portion with a pair of slits, the cylindrical portion covering the tongue portion and forming a mating portion together with the tongue portion. Each latch has a locking piece at a front distal end thereof and extends upwardly through the housing cover by the slit. The locking piece has a front straight edge which is vertical to an insertion direction of the plug connector and is at least partly located outside the cylindrical portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
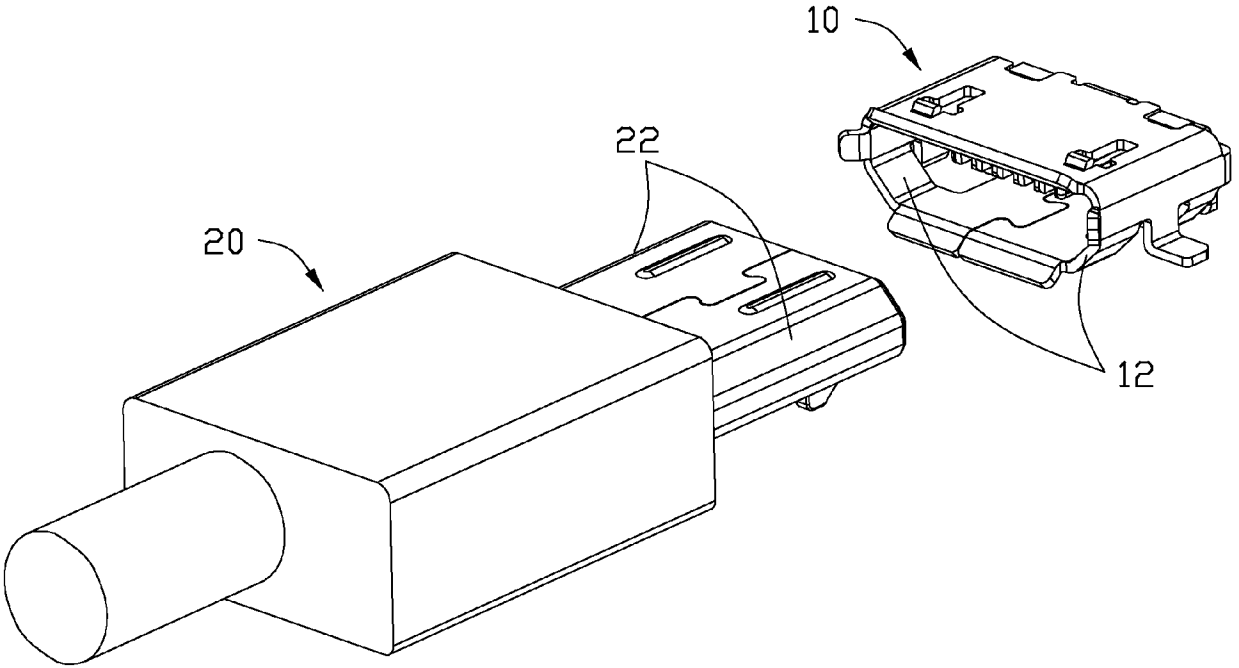
FIG. 1 (PRIOR ART)
FIG. 1 is a perspective view showing an electrical USB Micro B receptacle connector confronting an upside-down inserted Micro B plug in a conventional way.
Figure 2:
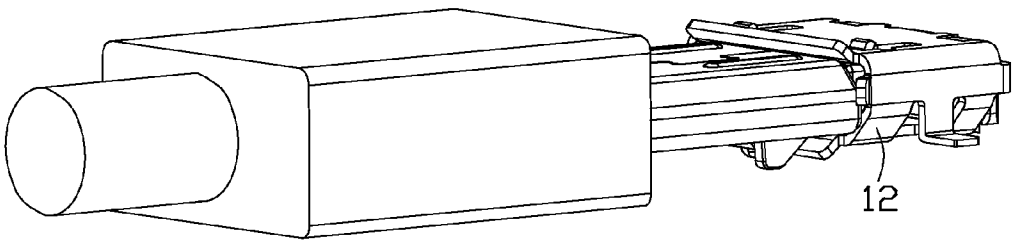
FIG. 2 (PRIOR ART)
FIG. 2 is a perspective view showing the upside-down inserted Micro B plug is stopped by the chamfered structures of the Micro B receptacle of FIG. 1.
Figure 3:
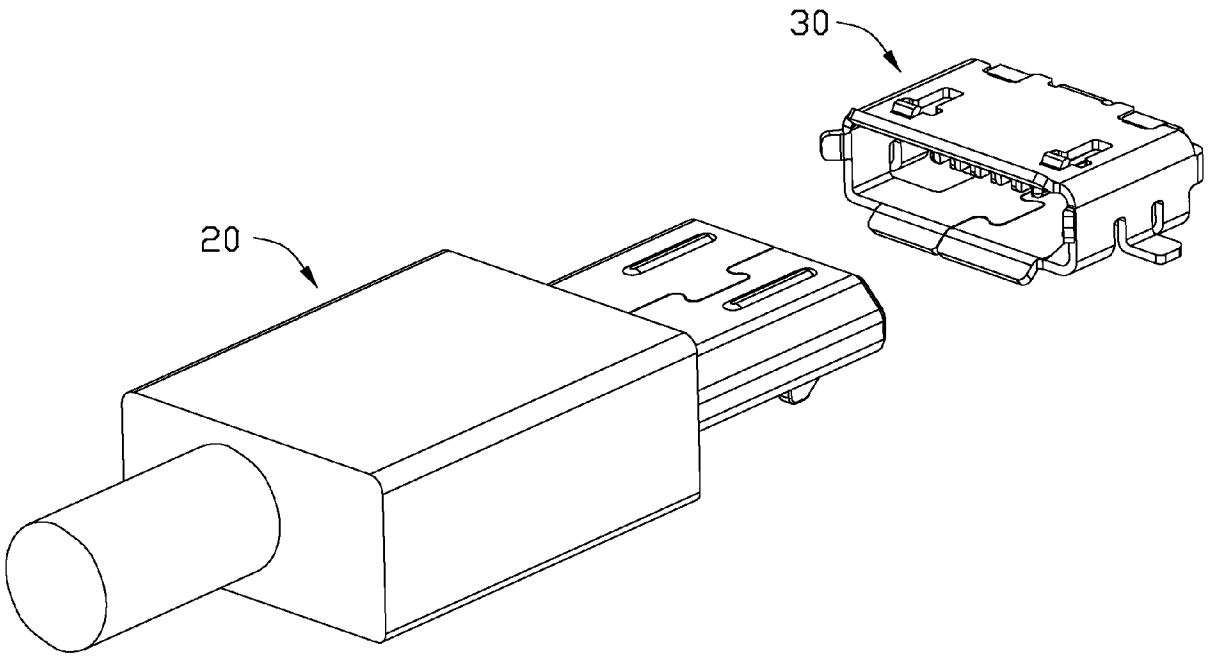
FIG. 3 (PRIOR ART)
FIG. 3 is a perspective view showing the Micro AB receptacle connector confronting an upside-down inserted Micro B plug in a conventional way.
Figure 4:
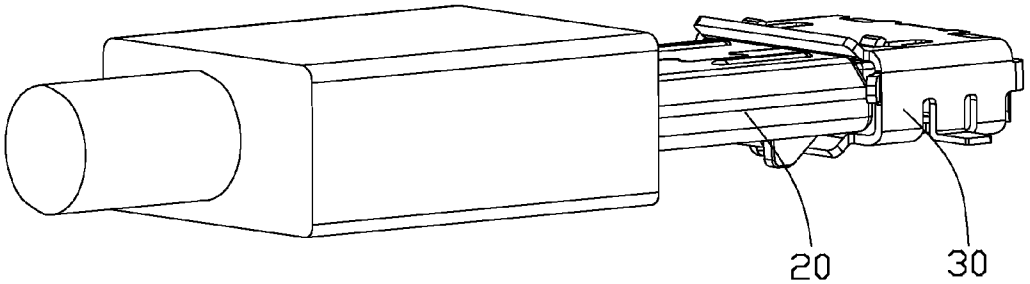
FIG. 4 (PRIOR ART)
FIG. 4 is a perspective view showing the upside inserted Micro B plug may mistakenly enter the mating port of the Micro AB receptacle of FIG. 3.

Reference will now be made to the drawing figures to describe the preferred embodiment of the present invention in detail.

Figure 5:
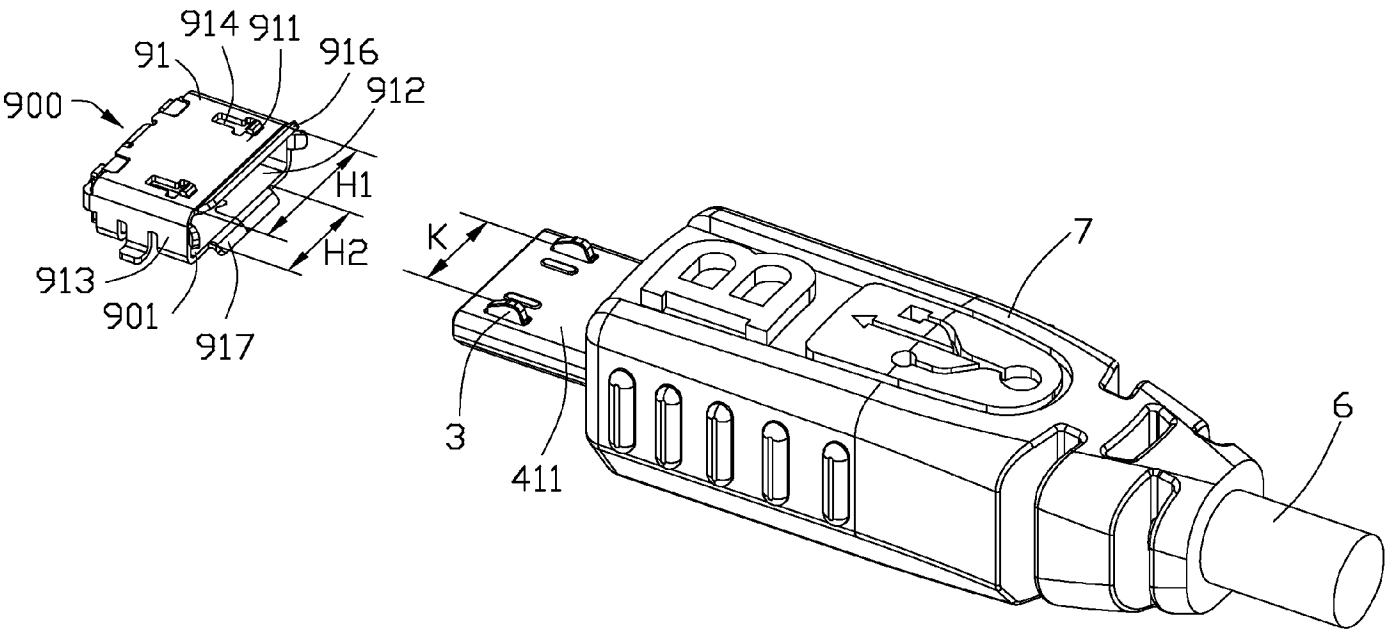
FIG. 5 is a perspective view of a cable connector according to a preferred embodiment of the present invention and a receptacle connector for mating with the cable connector.
Figure 6:
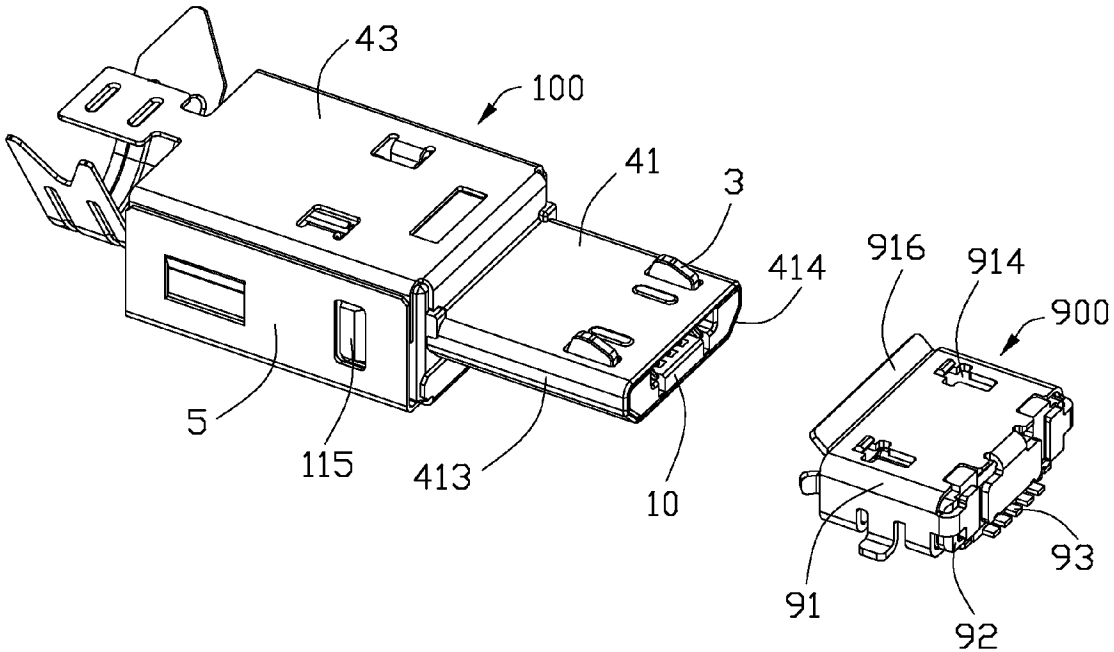
FIG. 6 is a perspective view of a plug connector of the cable connector and the receptacle connector.
Figure 7:
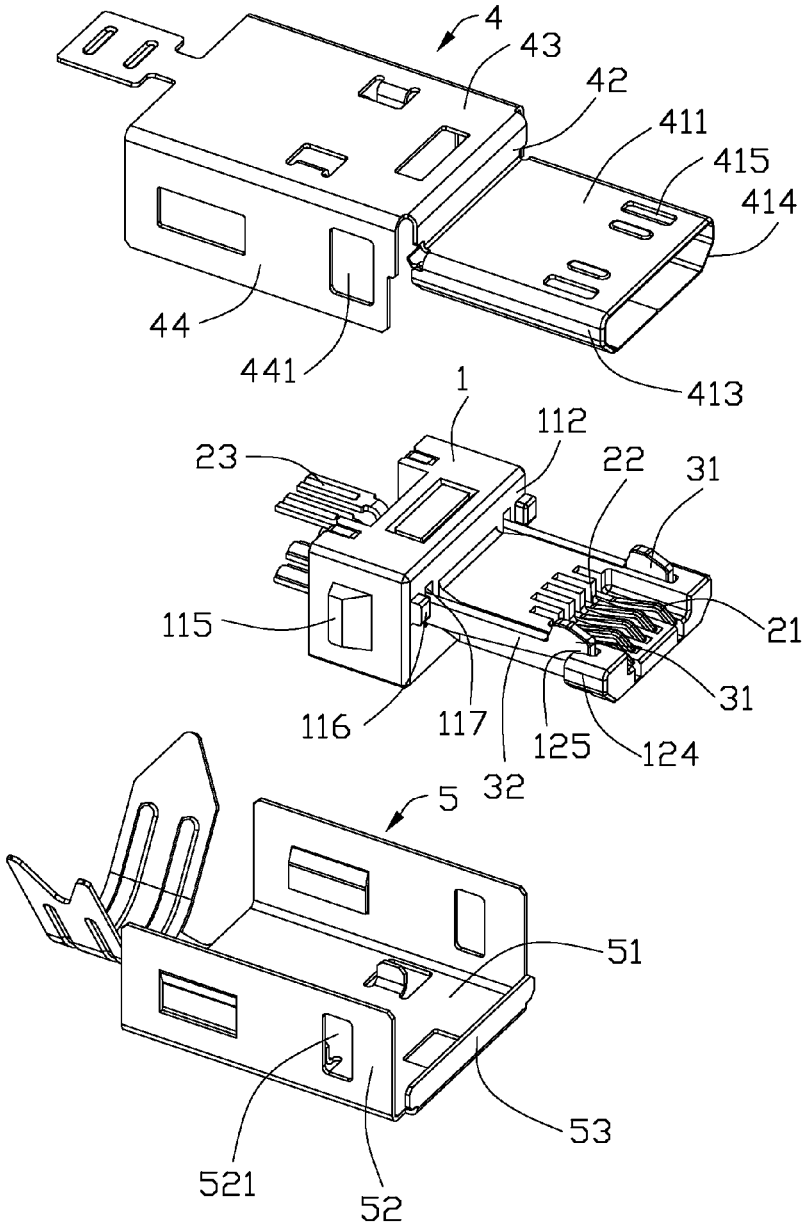
FIG. 7 is a partly exploded, perspective view of the plug connector.

Referring to FIGS. 5-7, a cable connector includes a plug connector 100, a cable 6 connecting with the plug connector 100 and an insulative shell 7 over-molding the plug connector 100 and the cable 6. The plug connector 100 includes an insulative housing 1 with a plurality of terminals 2 attached therein, a shell covering the insulative housing 1 and a pair of latches 3 retained in the insulative housing 1.

Figure 8:
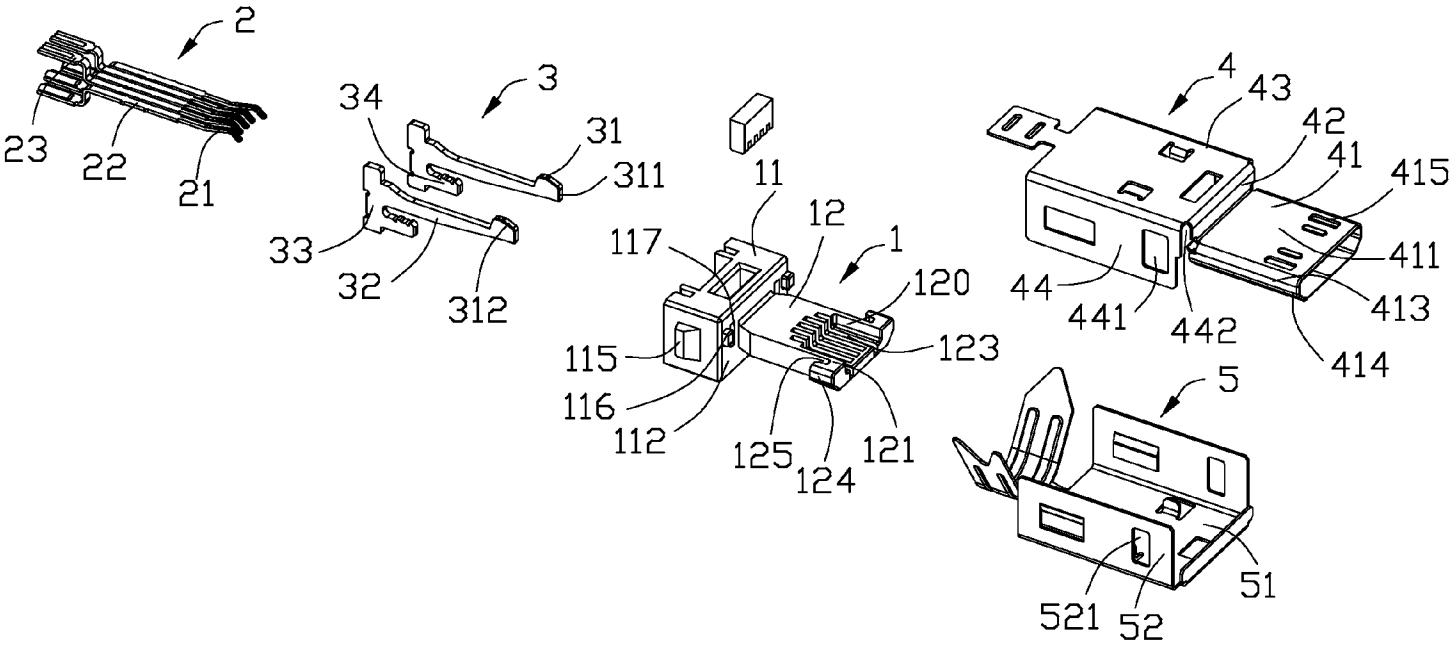
FIG. 8 is an exploded, perspective view of the plug connector.
Figure 9:
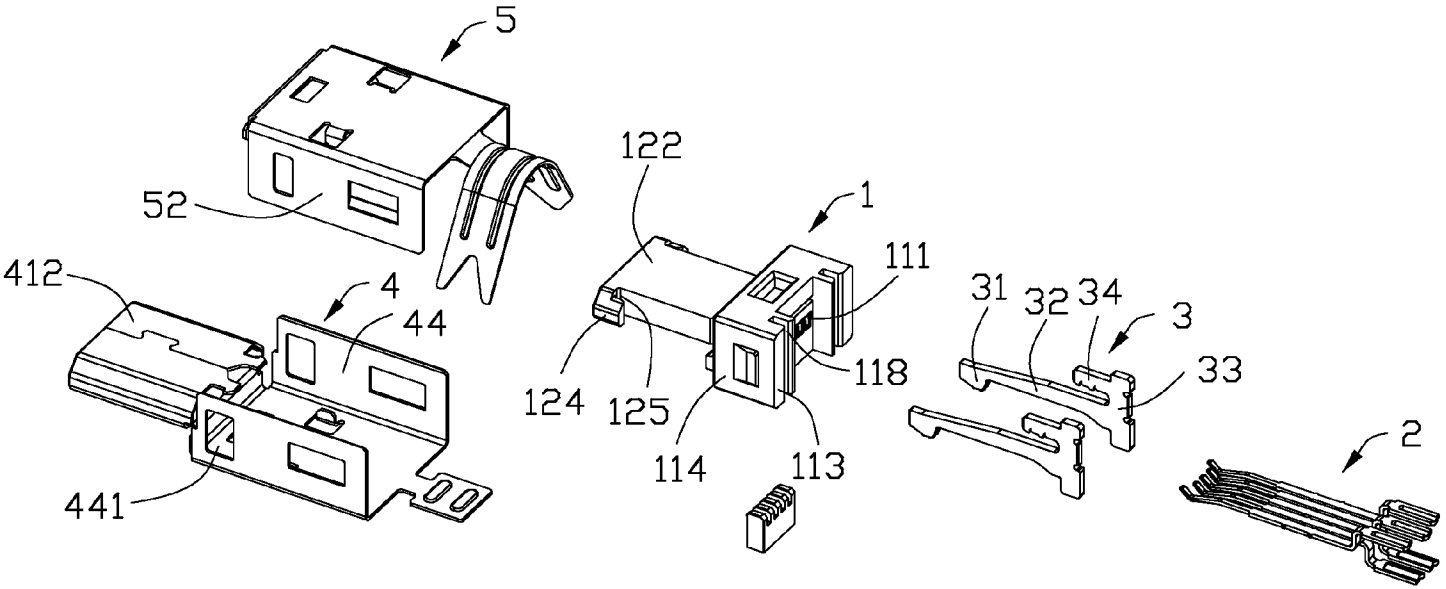
FIG. 9 is similar with FIG. 8, taken from another aspect.

Referring to FIGS. 7-9, the insulative housing 1 includes a base portion 11 and a tongue portion 12 extending forwardly from a middle of the base portion 11. The base portion 11 has a front face 112, a back face 113 opposite to the front face 112, two side faces 114 connecting with the front face 112 and the back face 113. The base portion 11 has a pair of protrusions 115 protruding sidewardly from the side faces 114, respectively, a pair of projections 116 extending forwardly from the front face 112, two retaining holes 117 extending from the front face 112 to the back face 113, two vertical grooves 118 depressing inwardly from the back face 113 and a plurality passageways 111 rearward extending through the base portion 11. The tongue portion 12 is located between the two retaining holes 115 and has a first surface 121, a second surface 122 opposite to the first surface 121, an opening 120 depressing downwardly from the first surface 121 to the second surface 122. a plurality of terminal receiving slots 123 further depressing from a bottom wall of the opening to the first surface 121 and communicating with the passageways 111 of the base portion 11. A pair of ear portions 124 are located beside two sides of a front end of the tongue portion 12, and a pair of cutouts 125 are formed between the ear portions 124 and the tongue portion 12.

Please referring to FIGS. 7-9, the shell comprises a first housing cover 4 and a second housing cover 5 combing with the first housing cover 4 to cover the insulative housing 1. The first housing cover 4 mainly includes a cylindrical portion 41 for enclosing the tongue portion 12, a bent portion 42 for rearward covering an upper front face of the base portion 11, an upper wall 43 for covering the upper surface of the base portion 11 and two side walls 44 for covering the side faces 114 of the base portion 11. The cylindrical portion 41 has a top wall 411, a bottom wall 412 opposite to the top wall 411, a pair of vertical walls 413 extending downwardly from two sides of the top wall 411 and a pair of inclined walls 414 connecting with the vertical walls 413 and two sides of the bottom wall 412 respectively. A width of the bottom wall 412 is narrower than that of the top wall 411. A pair of slits 415 extend through the top wall 411. The top wall 411, bottom wall 412, two vertical walls 413 and two inclined walls 414 together form a configuration to surround the tongue portion 12 and define a mating portion 10 (referring to FIG. 6) to mate with the receptacle connector 900. Two holes 441 extend through the side walls 44 and lock with the protrusions 115 to the base portion 11 to prevent a back-and-forth movement of the first housing cover 4. A pair of gaps 442 are formed between the bent portion 42 and two side walls 44 to lock with the projections 116 *o* of the base portion 11. The second housing cover 5 has a bottom wall 51, two side walls 52 vertically extending upwardly from two sides of the bottom wall 51 to cover a bottom face of the insulative housing 1 and a shorter front wall 53 extending upwardly from a front end of the bottom wall 51 to cover a bottom side of the front face 112 of the base portion 11. Two passing holes 521 are defined in the two side walls 52 to let the protrusions 115 pass through after the protrusions 115 pass through the holes 441 of the first housing cover 4.

Figure 15:
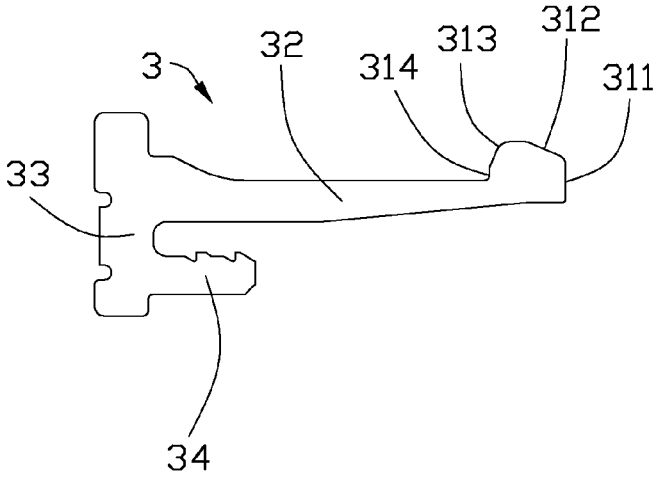
FIG. 15 is an enlarged perspective view of a latch retained in a tongue portion of the plug connector.

Please referring to FIGS. 7-8, conjoined with FIGS. 5-6, the latches 3 are arranged in parallel to the terminals 2 and sandwiching the terminals 2 therebetween along a left-to-right direction for locking with a receptacle connector 900 which is provided with a rectangular mating port 901. The two latches 3 has a distance K therebetween when assembled to the base portion 11. Each latch 3 has a retaining portion 33 at a rear distal end thereof received in the vertical grooves 118 of the base portion 11, a first front extending portion 32 extending through the retaining holes 117 and beyond the front face 112 of the base portion 11 from a top side of the retaining portion 33, a second front extending portion 34 extending from a bottom side of the retaining portion 33 and a locking piece 31 extending forwardly from the first front extending portion 32 and being received in the cutout 125. The locking piece 31 is shown as a vertical slice and deflectable upwardly. Referring to FIG. 15, the locking piece 31 has a front straight edge 311, an inclined edge 312 connecting with a top end of the front straight edge 311, a back straight edge 314 opposite to the front straight edge 311 and an arc edge 313 connecting with the incline edge 312 and the back straight edge 314.

Please referring to FIGS. 7-8, the terminals 2 are arranged in parallel along the left-to-right direction. Each terminal 2 has a retaining portion 22 retained in the tongue portion 12, an elastic contacting portion 21 extending forwardly from the retaining portion 22 and a tail portion 23 extending backwardly from the retaining portion 22. All of the tail portion 23, the elastic contacting portions 21 and the retaining portions 22. The retaining portions 22 are retained in the passageways 111 and the tail portions 23 extend beyond a back end of the passageways 111. The elastic contacting portions 21 of the terminals 2 protrude upwardly beyond the receiving slots 123.

Please referring to FIGS. 5-6, the receptacle connector 900 includes a hollow shield 91, an insulator 92 including a mating tongue (not shown) and surrounded by the shield 91 and a plurality of contacts 93 attached to the insulator 92. The shield 91 has a first wall 911, a second wall 912 opposite to the first wall 911, two third walls 913 connecting with the first wall 911 and the second wall 912 along the left-to-right direction. Two locking holes 914 are defined on the first wall 911 and extend through the first wall 911. The first wall 91 further comprises a first flange 916 bent upwardly from a front edge thereof and having a first length H1 along the left-to-right direction. The second wall 912 further comprises a second flange 917 bent downwardly from a front edge thereof and having a second length H2. The first length H1 is longer than the distance K between the two latches 3, the second length H2 is shorter than the distance K.

Figure 10:
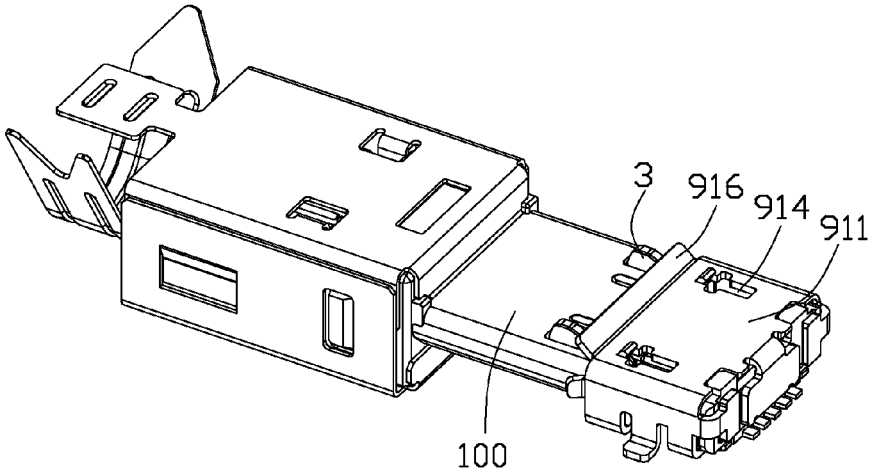
FIG. 10 is a perspective view of the plug connector inserted into the receptacle connector normally.
Figure 11:
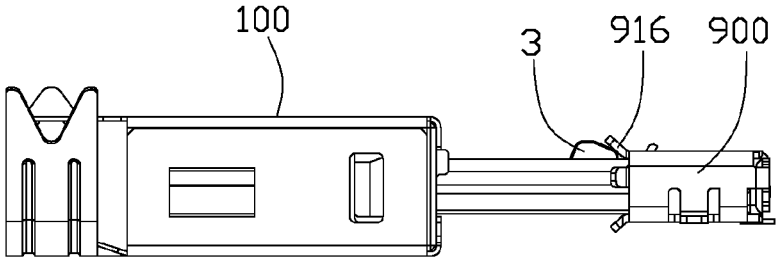
FIG. 11 is a similar view to FIG. 10, while taken from a different aspect.
Figure 12:
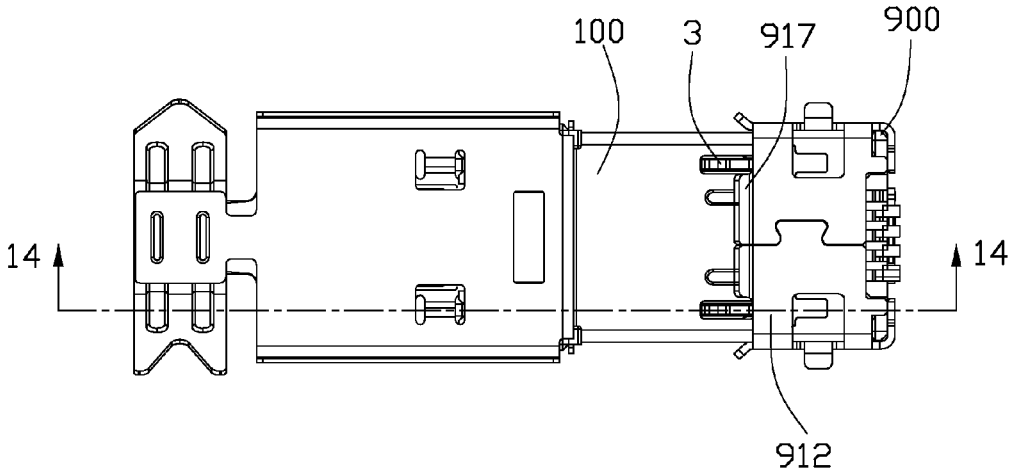
FIG. 12 is a perspective view of the plug connector inserted into the receptacle connector upside-down.
Figure 13:
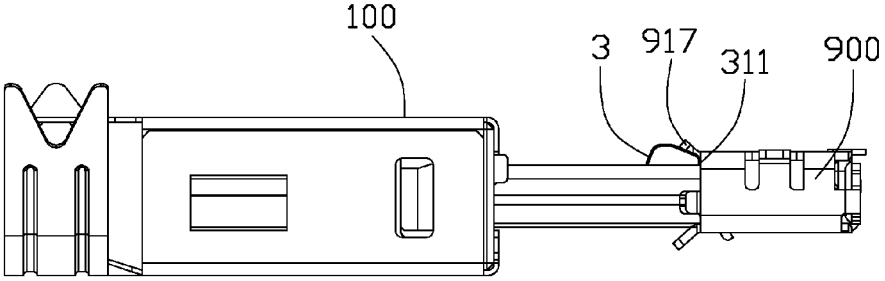
FIG. 13 is a similar view to FIG. 12, while taken from a different aspect.
Figure 14:
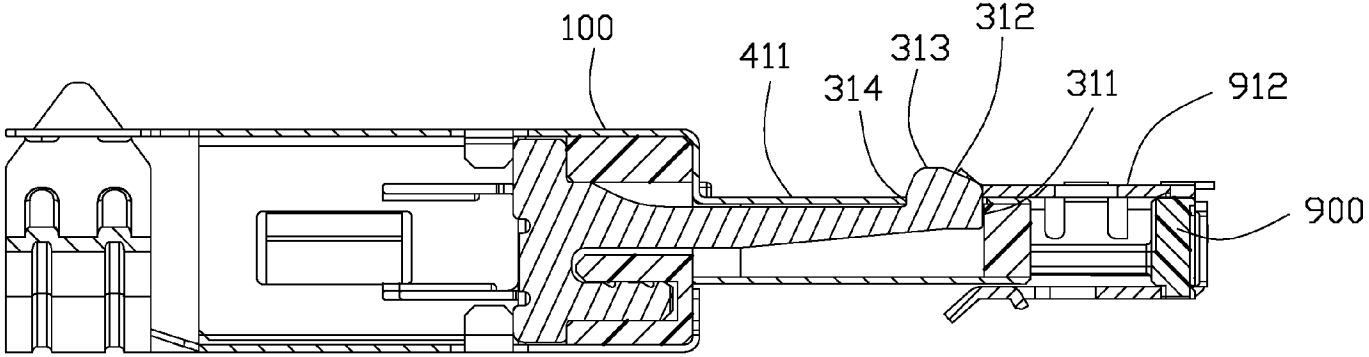
FIG. 14 is a cross-sectional view taken along line 10-10 of FIG. 12.

Please referring to FIGS. 10-11, conjoined with FIG. 13, when the plug connector 100 is normally inserted into the rectangular mating port 901 of the receptacle connector 900 under condition that the mating tongue (not shown) of the receptacle connector 900 is inserted into the cylindrical portion 411 of the plug connector 100, as the first length H1 is longer than the distance K between the two latches 3, the first flange 916 will push the latches 3 downwardly and forces them to hide in the receptacle connector 900 firstly, so that the plug connector 100 can continue to insert. Finally, the latches 3 return back when aligned with the locking holes 914 and lock with the locking holes 914. Please referring to FIGS. 9-10, when the plug connector 100 is inserted into the rectangular mating port 901 of the receptacle connector 900 upside down, as the second length H2 of the second flange 917 is shorter than the distance K between the two latches 3, the second flange 917 can not push the latches 3 down, a front edge of the second wall 912 besides the second flange 917 serves as a "hard stop" which engages with the front straight edges 311 of the latches 3 and prevents the plug connector 100 from being further inserted into the receptacle connector 900. Ultimately, the plug connector 100 can not be engaged with the receptacle connector 900 that protects both the plug connector 100 and receptacle connector 900.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a plug connector including:

an insulative housing comprising a base portion and a tongue portion extending forwardly from a middle of the base portion, the tongue portion having a first surface and a second surface opposite to the first surface;

a plurality of terminals retained to the insulative housing and exposed toward the first surface of the tongue portion in parallel;

a pair of deflectable latches fixed to the base portion and arranged in parallel to the terminals, the latches being positioned at outer sides of the terminals for locking with a receptacle connector with a rectangular mating port; and a housing cover having a cylindrical portion with a pair of slits, the cylindrical portion covering the tongue portion and forming a mating portion together with the tongue portion; wherein each of the latches comprises a locking piece at a front distal end thereof, the locking piece extends upwardly through the housing cover via the slit, and the locking piece has a front straight edge which is vertical to an insertion direction of the plug connector and is at least partly exposed outside the cylindrical portion in roughly a vertical direction for confrontation with either an oblique flange of the mating port of the receptacle connector for further deflection during correct mating thereby further insertion of the plug connector being allowed, or a stopping front edge of the mating port of the receptacle connector for non-deflection during incorrect mating thereby no further insertion of the plug connector being allowed.

2. The connector assembly as claimed in claim 1, wherein the locking piece further comprises an inclined edge connected with a top end of the front straight edge, a back straight edge opposite to the front straight edge and an arc edge connecting with the inclined edge and the back straight edge.

3. The connector assembly as claimed in claim 2, wherein the latch has a retaining portion formed at a back distal end thereof, a first front extending portion extending from a top side of the retaining portion, a second front extending portion extending from a bottom side of the retaining portion, the locking piece extends forwardly from the first front extending portion.

4. The connector assembly as claimed in claim 3, wherein each terminal has a retaining portion retained in the tongue portion, an elastic contacting portion extending forwardly from the retaining portion and a tail portion extending backwardly from the retaining portion.

5. The connector assembly as claimed in claim 4, wherein the tongue portion has an opening depressing downwardly from the first surface, a plurality of terminal receiving slots further depressing from a bottom wall of the opening, the elastic contacting portions of the terminals are received in the receiving slots and protruding into the opening.

6. The connector assembly as claimed in claim 5, wherein the insulative housing further defines a plurality passageways rearward extending through the base portion and in communication with the terminal receiving slots, the retaining portions of the terminals are retained in the passageways and the tail portions of the terminals extend beyond a back of the base portion.

7. The connector assembly as claimed in claim 5, wherein the tongue portion further comprises a pair of ear portions located beside two sides of a front end of the tongue portion, and a pair of cutouts formed between the ear portions and the tongue portion.

8. The connector assembly as claimed in claim 7, wherein the base portion comprises a pair of retaining holes extending through the base portion, the first front extending portion is retained in the retaining hole and extends forwardly, and the locking pieces are located in the cutouts and are floatable.

9. The connector assembly as claimed in claim 4, wherein the cylindrical portion has a top wall and a bottom wall, a width of the bottom wall is narrower than that of the top wall, the slits extend through the top wall.

10. The connector assembly as claimed in claim 9, wherein the cylindrical portion further comprises a pair of vertical walls extending downwardly from the top wall and a pair of inclined walls connecting with the vertical walls and the bottom wall respectively.

11. The connector assembly as claimed in claim 1, wherein said receptacle connector defining another insulative housing enclosed in another metallic housing cover, wherein said another housing cover defines, in a vertical direction, opposite first and second front longitudinal edges extending along a lengthwise direction perpendicular to said vertical direction, and the first front edge is equipped with said oblique flange to confront the corresponding latches for deflecting said latches during correct mating while the second front edge defines said stopping front edge for stopping incorrect mating.

12. A connector assembly comprising:

a plug connector including:

an insulative housing having a tongue portion with a plurality of terminal receiving slots depressing therein;

a housing cover partly covering the insulative housing and surrounding the tongue portion to form a mating portion together with the tongue portion, a slit extending through the housing cover;

a plurality of terminals arranged in the terminal receiving slots in parallel; and at least one latch with a locking piece arranged beside the terminals and being parallel to the terminals; wherein the locking piece protrudes out of the mating portion through the slit and comprises a front straight edge exposed, in a vertical direction, outside of the mating portion with a height dimensioned not only to be large enough to efficiently confront a stopping edge of a rectangular mating port of a receptacle connector for stopping further insertion of the plug connector into said receptacle connector during mis-mating but also to be smaller enough to comply with an oblique flange of the rectangular mating port of the receptacle connector for further insertion of the plug connector into the receptacle connector during correct mating.

13. The connector assembly as claimed in claim 12, wherein the tongue portion further comprises a pair of ear portions located beside of a front end of the tongue portion, and a pair of cutouts formed between the ear portions and the tongue portion.

14. The connector assembly as claimed in claim 13, wherein the at least one latch has a first front extending portion extending along a front-to-back direction and located at a side of the tongue portion, the front extending portion is shown as a vertical slice.

15. The plug connector as claimed in claim 14, wherein the at least one latch comprise a retaining portion retained in the insulative housing, the first extending portion extending forwardly from the retaining portion, the locking piece further extending forwardly from the first extending portion and being floatable in the cutout.

16. The connector assembly as claimed in claim 12, wherein said receptacle connector defining another insulative housing enclosed in another metallic housing cover, wherein said another housing cover defines, in a vertical direction, opposite first and second front longitudinal edges extending along a lengthwise direction perpendicular to said vertical direction, and the first front edge is equipped with said oblique flange to confront the corresponding latches for deflecting said latches during correct mating while the second front edge defines said stopping edge for stopping incorrect mating.

* * * * *